US011864582B2

(12) United States Patent
Reevell

(10) Patent No.: US 11,864,582 B2
(45) Date of Patent: Jan. 9, 2024

(54) AEROSOL-GENERATING ARTICLE HAVING MELTABLE ELEMENT

(71) Applicant: Philip Morris Products S.A., Neuchatel (CH)

(72) Inventor: Tony Reevell, London (GB)

(73) Assignee: Philip Morris Products S.A., Neuchatel (CH)

( * ) Notice: Subject to any disclaimer, the term of this patent is extended or adjusted under 35 U.S.C. 154(b) by 725 days.

(21) Appl. No.: 17/045,917

(22) PCT Filed: Apr. 8, 2019

(86) PCT No.: PCT/EP2019/058766

§ 371 (c)(1),
(2) Date: Oct. 7, 2020

(87) PCT Pub. No.: WO2019/197316

PCT Pub. Date: Oct. 17, 2019

(65) Prior Publication Data

US 2021/0030071 A1 Feb. 4, 2021

(30) Foreign Application Priority Data

Apr. 9, 2018 (EP) ..... 18166413

(51) Int. Cl.
*A24D 1/00* (2020.01)
*A24F 40/57* (2020.01)
(Continued)

(52) U.S. Cl.
CPC ..... *A24D 1/002* (2013.01); *A24D 1/20* (2020.01); *A24F 40/48* (2020.01); *A24F 40/57* (2020.01); *A24F 40/20* (2020.01); *A24F 40/46* (2020.01)

(58) Field of Classification Search
CPC .. A24D 1/00; A24D 1/002; A24D 1/20; A24F 40/20; A24F 40/40; A24F 40/46; A24F 40/48; A24F 40/50; A24F 40/57
(Continued)

(56) References Cited

U.S. PATENT DOCUMENTS 4,984,588 A 1/1991 Stewart, Jr.
5,992,420 A 11/1999 Moriyama
(Continued)

FOREIGN PATENT DOCUMENTS

CN 105167182 A 12/2015
CN 105992524 A 10/2016
(Continued)

OTHER PUBLICATIONS

Japanese Office Action dated Apr. 6, 2023 in Japanese Patent Application No. 2020-550800 (with English Translation), 6 pages.
(Continued)

*Primary Examiner* — Khiem M Nguyen
(74) *Attorney, Agent, or Firm* — Oblon, McClelland, Maier & Neustadt, L.L.P.

(57) ABSTRACT

An aerosol-generating article for an aerosol-generating device having a heating element, is provided, the article including: a rod of aerosol-generating substrate; and a heat control component disposed downstream of the rod of aerosol-generating substrate and including a meltable element arranged within the heat control component such that one or more longitudinal airflow channels are provided through the heat control component, and the meltable element is configured to melt when heated above a threshold temperature such that upon melting of the meltable element the one or more longitudinal airflow channels through the heat control component are blocked such that airflow through the aerosol-generating article is substantially prevented. An aerosol-generating system including the aerosol-generating article and an aerosol-generating device is also provided.

15 Claims, 3 Drawing Sheets

(51) Int. Cl.

| | |
|---|---|
| ***A24F 40/46*** | (2020.01) |
| ***A24F 40/48*** | (2020.01) |
| ***A24D 1/20*** | (2020.01) |
| *A24F 40/20* | (2020.01) |

(58) Field of Classification Search
USPC ..... 131/329
See application file for complete search history.

(56) References Cited

U.S. PATENT DOCUMENTS

| | | | | |
|---|---|---|---|---|
| 2008/0276947 | A1 | 11/2008 | Martzel | |
| 2015/0027458 | A1 | 1/2015 | Grant | |
| 2016/0295917 | A1 | 10/2016 | Malgat et al. | |
| 2016/0353799 | A1 | 12/2016 | Otto | |
| 2017/0303585 | A1 | 10/2017 | Florack et al. | |
| 2021/0030071 | A1* | 2/2021 | Reevell | A24F 40/48 |

FOREIGN PATENT DOCUMENTS

| | | | |
|---|---|---|---|
| EP | 0 077 123 | A2 | 4/1983 |
| EP | 0 822 670 | A2 | 2/1998 |
| JP | 2016-538847 | A | 12/2016 |
| JP | 2017-532031 | A | 11/2017 |
| RU | 96 122 286 | A | 1/1999 |
| WO | WO 2012/164009 | A2 | 12/2012 |
| WO | WO 2013/097158 | A1 | 7/2013 |
| WO | WO 2013/098405 | A2 | 7/2013 |
| WO | WO 2014/139611 | A1 | 9/2014 |
| WO | WO 2015/082650 | A1 | 6/2015 |

OTHER PUBLICATIONS

Combined Chinese Office Action and Search Report dated Jul. 20, 2022, in corresponding Chinese Patent Application No. 201980019671.3 (with English Translation), 9 pages.

Combined Russian Office Action and Search Report dated Aug. 3, 2022, in corresponding Russian Patent Application No. 2020136240 (with English Translation), 13 pages.

International Search Report and Written Opinion dated Aug. 1, 2019 in PCT/EP2019/058766 filed on Apr. 8, 2019.

* cited by examiner

AEROSOL-GENERATING ARTICLE HAVING MELTABLE ELEMENT

The present invention relates to a heated aerosol-generating article incorporating a heat control component comprising a meltable element, and to an aerosol-generating system comprising such a heated aerosol-generating article.

Aerosol-generating articles in which an aerosol-generating substrate, such as a tobacco-containing substrate, is heated rather than combusted, are known in the art. Typically in such heated smoking articles, an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming or smoking heated aerosol-generating articles. Such devices include, for example, electrically heated aerosol-generating devices in which an aerosol is generated by the transfer of heat from one or more electrical heating elements of the aerosol-generating device to the aerosol-generating substrate of a heated aerosol-generating article. One advantage of such electrically heated aerosol-generating devices is that they significantly reduce sidestream smoke.

In such aerosol-generating devices, the heating element will typically be configured to heat the aerosol-generating substrate within a defined temperature range which has been selected by the manufacturer to provide an optimal aerosol release profile from the aerosol-generating article. The aerosol-generating article and aerosol-generating device are therefore specifically adapted for use in conjunction with each other.

However, where an aerosol-generating article is inadvertently or intentionally used with an non-compatible aerosol-generating device, an optimal aerosol release profile is very unlikely to be provided to the consumer. The construction of the heating element in the non-compatible device will typically be different to that of the compatible device and the form of heating of the aerosol-generating substrate is therefore likely to be different. Furthermore, the heater may not be operated in the same way within the same temperature ranges, so that the aerosol-generating substrate will not be heated under the same temperature profile as in a compatible device. As a result, the properties of the aerosol released from the substrate will not be as intended by the manufacturer. The experience of the consumer will likely therefore be adversely affected as a result of using the aerosol-generating article with a non-compatible device.

Particular problems may arise when an aerosol-generating article is used in a device that heats the aerosol-generating substrate to a higher temperature than intended, such that at least a part of the substrate becomes overheated. This may occur, for example, when an aerosol-generating article that is adapted to be heated by an internal heating element is instead used in an aerosol-generating device that heats the aerosol-generating article externally. Such devices that heat the substrate from the outside during use typically require much higher operating temperatures and therefore at least the outer parts of the substrate are likely to be heated to a much higher temperature than would be provided using an internal heating element.

It would be desirable to provide a novel arrangement of an aerosol-generating article which prevents the use of the aerosol-generating article with a non-compatible aerosol-generating device and in particular, with a non-compatible device that heats the aerosol-generating substrate to a higher temperature than is intended. It would be further desirable to provide such a novel arrangement of an aerosol-generating article which does not adversely impact the use of the aerosol-generating article under normal heating conditions in a compatible device. It would be particularly desirable if such a novel arrangement of an aerosol-generating article could be readily provided without significantly impacting the construction of the aerosol-generating article or the method and apparatus used for the production of the aerosol-generating article.

According to a first aspect of the present invention, there is provided a heated aerosol-generating article for use with an aerosol-generating device having a heating element, the heated aerosol-generating article comprising: a rod of aerosol-generating substrate; and a heat control component positioned downstream of the rod of aerosol-generating substrate and comprising a meltable element. The meltable element is arranged within the heat control component such that one of more longitudinal airflow channels are provided through the heat control component. The meltable element is adapted to melt when heated above a threshold temperature such that upon melting of the meltable element the one or more longitudinal airflow channels through the heat control component are blocked, whereby airflow through the aerosol-generating article is substantially prevented.

According to a second aspect of the present invention, there is provided an aerosol-generating system comprising an aerosol-generating article according to the first aspect of the invention, as defined above; and an aerosol-generating device adapted to receive the aerosol-generating article. The aerosol-generating device comprises a heating element configured to heat the rod of aerosol-generating substrate during use wherein the heating element is controlled during use to operate below a maximum operating temperature. The meltable element of the aerosol-generating article is adapted such that the threshold temperature is not exceeded during use of the aerosol-generating system with the heating element operating below the maximum operating temperature.

As used herein, the term "heated aerosol-generating article" refers to an aerosol-generating article for producing an aerosol comprising an aerosol-generating substrate that is intended to be heated rather than combusted in order to release volatile compounds that can form an aerosol. Such articles are commonly referred to as "heat-not-burn" products.

As used herein, the term "aerosol-generating substrate" refers to a substrate capable of releasing upon heating volatile compounds, which can form an aerosol. The aerosol generated from aerosol-generating substrates of aerosol-generating articles described herein may be visible or invisible and may include vapours (for example, fine particles of substances, which are in a gaseous state, that are ordinarily liquid or solid at room temperature) as well as gases and liquid droplets of condensed vapours.

As used herein, the term "rod" refers to a generally cylindrical element of substantially polygonal cross-section and preferably of circular, oval or elliptical cross-section.

As used herein, the term "longitudinal" refers to the direction corresponding to the main longitudinal axis of the aerosol-generating article, which extends between the upstream and downstream ends of the aerosol-generating article. During use, air is drawn through the aerosol-generating article in the longitudinal direction. The term "transverse" refers to the direction that is perpendicular to the longitudinal axis.

As used herein, the terms "upstream" and "downstream" describe the relative positions of elements, or portions of elements, of the aerosol-generating article in relation to the direction in which the aerosol is transported through the aerosol-generating article during use.

Aerosol-generating articles according to the present invention are suitable for use in an aerosol-generating system comprising an electrically heated aerosol-generating device having an internal heating element for heating the aerosol-generating substrate. For example, aerosol-generating articles according to the invention find particular application in aerosol-generating systems comprising an electrically heated aerosol-generating device having an internal heater blade which is adapted to be inserted into the rod of aerosol-generating substrate. Aerosol-generating articles of this type are described in the prior art, for example, in European patent application EP-A-0 822 670.

As used herein, the term "aerosol-generating device" refers to a device comprising a heating element that interacts with the aerosol-generating substrate of the aerosol-generating article to generate an aerosol.

As described above, aerosol-generating articles according to the present invention incorporate a heat control component comprising a meltable element. The heat control component provides a safe and effective means for preventing use of the aerosol-generating article in a non-compatible device that heats the aerosol-generating article excessively above a desired operating temperature range. The heat control component therefore provides means for prevention of overheating of the aerosol-generating article.

The meltable element is adapted such that upon melting, the airflow channels through the heat control component are blocked, thereby making it difficult or impossible for the consumer to draw air through the aerosol-generating article. In this way, the consumer will be alerted to the fact that he is attempting to use the aerosol-generating article with a non-compatible aerosol-generating device and will not be able to continue with smoking of the aerosol-generating article.

Advantageously, the meltable element is adapted so that it will only melt at excessive operating temperatures. Therefore, when the aerosol-generating articles according to the invention are heated normally in a compatible aerosol-generating device, the presence of the heat control component will not perceivably impact the consumer experience. In particular, the presence of the airflow channels through the heat control component ensure that the presence of the heat control component does not adversely impact the resistance to draw (RTD) of the aerosol-generating article.

The heat control component comprising the meltable element can be conveniently incorporated into an aerosol-generating article without significantly impacting the arrangement of the other components of the article. The inclusion of the heat control component should not therefore significantly impact the manufacture of the aerosol-generating articles. Aerosol-generating articles according to the invention can therefore advantageously be made using existing high speed methods and apparatus, with only minor modifications.

As described above, the heat control component is provided within the aerosol-generating article, at a position downstream of the aerosol-generating substrate so that the aerosol generated from the aerosol-generating substrate during use must be drawn through the heat control component as it passes downstream to the consumer. It is therefore essential that the heat control component is constructed with a meltable element that is shaped and positioned such that one or more airflow channels are provided through the heat control component. During normal operation, the aerosol can therefore be drawn through the airflow channels so that the airflow through the aerosol-generating article and the delivery of the aerosol to the consumer are unaffected by the presence of the heat control component.

In the event that the aerosol-generating article is overheated, for example in a non-compatible device, so that the meltable element reaches its threshold temperature, the meltable element will melt to "activate" the heat control component. The resultant molten material is capable of flowing within the heat control component and will flow to block the airflow channels. With the airflow channels blocked by the melted material, the RTD of the aerosol-generating article will increase significantly, preferably above 1000 mm $H_2O$, thereby effectively preventing the further use of the aerosol-generating article. The activation of the heat control component will typically be irreversible since it will not be possible to unblock the airflow channels once the meltable element has melted.

The "threshold temperature" of the meltable element corresponds to the temperature at which the meltable element will change from a solid to a molten state, as described above. This will typically correspond to the melting point of the material used to form the meltable element. As discussed in more detail below, the threshold temperature of the meltable element will be selected so that it will only be reached or exceeded when the aerosol-generating article is overheated, that is, heated above the intended operating temperature range. The threshold temperature will therefore correspond to the temperature reached at the meltable element when the aerosol-generating substrate is heated above the maximum desired temperature, as determined by the manufacturer.

There are several potential ways in which the heat control component may be adapted so that activation occurs at the desired threshold temperature and so that the airflow channels are effectively blocked to prevent further use of the aerosol-generating article.

A suitable material should be selected for forming the meltable element, wherein the material has an appropriate melting point to ensure that there is no risk of the meltable element melting when the aerosol-generating article is heated to within a normal operating temperature range but so that the meltable element melts rapidly when the aerosol-generating article is heated to a temperature above this range.

A suitable position of the heat control component within the aerosol-generating article will also need to be selected. The appropriate position for the heat control component will depend to a large extent upon the selected material so that the threshold temperature can be defined appropriately. This will avoid the unintended activation of the heat control component during normal use of the aerosol-generating article.

Typically, during use, the aerosol-generating article will be inserted into an aerosol-generating device such that the aerosol-generating substrate is heated, either directly or indirectly, by a heating element within the device. The temperature within the aerosol-generating article will be highest adjacent to the heating element and will decrease through the aerosol-generating article with increasing distance from the heating element. The appropriate threshold temperature for the meltable element will therefore be different depending on how far the heat control component is placed downstream from the aerosol-generating substrate. In particular, the further the heat control component is placed downstream of the aerosol-generating substrate, the lower the threshold temperature will need to be.

The temperature profile within an aerosol-generating article can be readily measured using thermocouples such that an appropriate threshold temperature can be determined to ensure that the heat control component is activated only when the substrate is deemed to be overheated, above a defined maximum temperature.

The shape and size of the meltable element may be adapted to ensure that sufficient airflow pathways are provided for normal use of the aerosol-generating article whilst also ensuring that upon melting, the molten material from the meltable element will be of a sufficient volume to effectively block the airflow channels.

In certain preferred embodiments of the invention, the heat control component comprises a meltable disc having a transverse cross section substantially corresponding to the transverse cross section of the rod of aerosol-generating substrate and comprising one or more holes extending through the meltable disc to provide the one or more longitudinal airflow channels.

As used herein, the term "disc" refers to a meltable element that is relatively flat so that the dimension of the meltable element in the longitudinal direction of the aerosol-generating article is relatively small compared to its transverse dimensions. The use of a meltable element in the form of a disc advantageously means that the meltable element does not occupy much space within the aerosol-generating article.

Preferably, the meltable disc has a thickness of at least 1 millimetre, wherein the thickness of the disc corresponds to the dimension in the longitudinal direction of the aerosol-generating article. Preferably, the meltable disc has a thickness of no more than 10 millimetres.

In such embodiments, the meltable disc may be provided with a single hole to provide a single longitudinal airflow channel through the meltable disc. The single hole is preferably positioned approximately centrally in the disc. The single hole may be circular or elongate, for example, a slit. In some cases, an elongate hole may be easier to close upon melting of the meltable element. Preferably, the single hole has a transverse cross sectional area of between about 3 square millimetres and about 30 square millimetres to ensure that a sufficient airflow through the heat control component can be achieved during normal use.

Alternatively, the meltable disc may be provided with a plurality of spaced apart holes to provide a plurality of longitudinal airflow channels through the disc. For example, the meltable disc may be provided with between about 2 and about 10 holes. This arrangement of a plurality of spaced apart holes can provide the same total transverse cross sectional area of airflow channels as a single hole but the smaller holes may close more easily and more quickly upon melting of the meltable element above the threshold temperature.

Preferably, the meltable disc is a self-supporting component which can be readily incorporated at the desired position along the aerosol-generating article. In such embodiments, the disc can be held in position by a friction fit, as a result of friction between the outer edges of the disc and the inner surface of the surrounding wrapper.

The heat control component may consist of the meltable disc only. This advantageously provides a very simple construction for the heat control component, which enables it to be readily incorporated into the aerosol-generating article without impacting the overall construction of the aerosol-generating article to a significant extent. Alternatively, the meltable disc may be combined with one or more other components to form the heat control component.

In alternative embodiments of the present invention, the heat control component comprises a central longitudinal cavity, wherein the meltable element is mounted within the central cavity such that one or more airflow channels are provided through the central cavity, around the meltable element. Upon melting of the meltable element, the central cavity is blocked. In such embodiments, the meltable element therefore has a maximum dimension that is smaller than the internal diameter of the central cavity, such that there is space between the outer surfaces of the meltable element and the inner surfaces of the central cavity to provide one or more airflow channels.

In such embodiments, the meltable element of the heat control component is preferably a spherical bead or ball mounted within the central cavity. The spherical bead or ball preferably has a diameter that is smaller than the transverse diameter of the central longitudinal cavity. Upon melting of the bead or ball at the threshold temperature, it spreads out transversely so that the central cavity becomes blocked and airflow is substantially prevented.

The transverse spreading of the melted ball or bead to block the central cavity may occur as a result of wicking action, particularly where the diameter of the central cavity is relatively small. Alternatively or in addition, means may be provided within the central cavity to assist the transverse spreading of the melted material from the meltable element. For example, a transverse screen of an air permeable material may be provided inside the meltable element which helps to direct the melted material transversely across the central cavity. The material of the transverse screen must be selected such that the presence of the screen does not impact the passage of the aerosol through the heat control component during normal use.

The central cavity of the heat control component may be defined by a wrapper circumscribing at least a portion of the aerosol-generating article, such as a plug wrap. Alternatively, the heat control component may further comprise a hollow tubular element, such as a hollow acetate tube, having a central channel in which the meltable element is provided.

Preferably, the internal diameter of the central cavity is between about 2 millimetres and about 7 millimetres.

Preferably, the length of the central cavity is between about 1 millimetre and about 42 millimetres.

As discussed above, the heat control component of aerosol-generating articles according to the present invention is always provided downstream of the aerosol-generating substrate.

In certain embodiments, the heat control component may be provided directly adjacent to the aerosol-generating substrate, immediately downstream thereof. In such embodiments, the threshold temperature of the meltable element will need to be relatively high due to the likely proximity to the heating element of the aerosol-generating device during use.

Preferably, where the heat control component is provided adjacent to the aerosol-generating substrate, the threshold temperature is at least about 140 degrees Celsius, more preferably at least about 150 degrees Celsius. Alternatively or in addition, the threshold temperature in such embodiments is less than about 200 degrees Celsius, more preferably less than about 180 degrees Celsius. This ensures that the meltable element is sufficiently sensitive to heating of the aerosol-generating substrate above the maximum desired temperature.

Suitable materials for use in forming the meltable element of such embodiments therefore preferably have a melting point that is within this preferred range of threshold temperature (140 degrees Celsius to 200 degrees Celsius). For example, the meltable element may be formed of a high melting point plastics material, such as polyethylene or polypropylene isotactic. Alternatively, the meltable element may be formed of a crystalline solid with a melting point within the preferred range of threshold temperature such as glucose.

Aerosol-generating articles commonly comprise a hollow acetate tube directly adjacent to the aerosol-generating substrate. In aerosol-generating articles according to the invention, a hollow acetate tube in this position may be incorporated as part of the heat control component, as described above for embodiments in which the meltable element is mounted within a hollow tubular element. Alternatively, the heat control component may replace the hollow acetate tube, for example, for embodiments in which the meltable element is provided in the form of a disc, as discussed above.

In other embodiments of the present invention, the heat control component may be separated from the aerosol-generating substrate by one or more other components of the aerosol-generating article. In this case, a meltable element having a lower threshold temperature will be needed as the distance between the meltable element and the aerosol-generating substrate (and therefore the heating element) increases.

The heat control component may be provided upstream of and adjacent to a mouthpiece providing the mouth end of the aerosol-generating article, for example, between the mouthpiece and an aerosol cooling element, where present. With such an arrangement, the threshold temperature will need to be significantly lower than the range defined for the embodiments above in which the heat control component is provided adjacent to the aerosol-generating substrate.

Preferably, where the heat control component is provided adjacent to the mouthpiece, the threshold temperature is at least about 80 degrees Celsius, more preferably at least about 100 degrees Celsius and most preferably at least 120 degrees Celsius. Alternatively or in addition, the threshold temperature in such embodiments is less than about 150 degrees Celsius, more preferably less than about 140 degrees Celsius. This ensures that the meltable element is sufficiently sensitive to detect overheating of the aerosol-generating substrate, despite the increased distance between the heat control component and the aerosol-generating substrate.

Suitable materials for use in forming the meltable element of such embodiments therefore preferably have a melting point that is within this preferred range of threshold temperature (80 degrees Celsius to 140 degrees Celsius). For example, the meltable element may be formed of a lower melting point plastics material, such as low density polyethylene, or a microcrystalline wax.

In general, for all embodiments of the present invention, the meltable element is preferably formed of a material that can be readily moulded to form the desired shape and which provides a suitable melting point depending on the position of the heat control component in the aerosol-generating article, as discussed above. At room temperature, the material forming the meltable element should be sufficiently hard that it retains its shape and can withstand the typical forces to which it will be subjected during manufacture and normal handling. When melted, the material forming the meltable element must be capable of flowing through the heat control component to fill the airflow channels. The flow rate of the melted material should be sufficiently high that the heat control component can respond relatively quickly to overheating of the aerosol-generating article.

In some embodiments, the material forming the meltable element may be encased in a sealed cover layer such that the material is prevented from coming into contact with the aerosol passing through the heat control component during normal use. This protects the material, for example, if it may otherwise be sensitive to moisture in the aerosol. Where present, the sealed cover layer is preferably formed of a flexible material that enables the meltable element to change shape when melted, in order to block the airflow channels as described above. Suitable materials for forming the cover layer would be known to the skilled person and include, for example, a metal foil.

The aerosol-generating articles according to the present invention may comprise a plurality of elements, including the rod of aerosol-generating substrate and the heat control component, assembled within a wrapper, such as a cigarette paper.

The rod of aerosol-generating substrate is formed of an aerosol-forming material, which is particularly preferably homogenised tobacco material.

As used herein, the term "homogenised tobacco material" encompasses any tobacco material formed by the agglomeration of particles of tobacco material. Sheets or webs of homogenised tobacco material are formed by agglomerating particulate tobacco obtained by grinding or otherwise powdering of one or both of tobacco leaf lamina and tobacco leaf stems. In addition, homogenised tobacco material may comprise a minor quantity of one or more of tobacco dust, tobacco fines, and other particulate tobacco by-products formed during the treating, handling and shipping of tobacco. The sheets of homogenised tobacco material may be produced by casting, extrusion, paper making processes or other any other suitable processes known in the art.

In preferred embodiments, the rod comprises one or more sheets of a homogenised tobacco material that have been gathered to form a plug and circumscribed by an outer wrapper. As used herein with reference to the invention, the term "sheet" describes a laminar element having a width and length substantially greater than the thickness thereof. As used herein with reference to the invention, the term "gathered" describes a sheet that is convoluted, folded, or otherwise compressed or constricted substantially transversely to the longitudinal axis of the aerosol-generating article.

Advantageously, the aerosol-generating substrate comprises a gathered textured sheet of homogenised tobacco material. As used herein with reference to the invention, the term "textured sheet" describes a sheet that has been crimped, embossed, debossed, perforated or otherwise deformed.

Use of a textured sheet of homogenised tobacco material may advantageously facilitate gathering of the sheet of homogenised tobacco material to form the aerosol-generating substrate.

The aerosol-generating substrate may comprise a gathered textured sheet of homogenised tobacco material comprising a plurality of spaced-apart indentations, protrusions, perforations or any combination thereof.

In certain preferred embodiments, the aerosol-generating substrate comprises a gathered crimped sheet of homogenised tobacco material. As used herein with reference to the invention, the term "crimped sheet" describes a sheet having a plurality of substantially parallel ridges or corrugations. Advantageously, when the aerosol-generating article has been assembled, the substantially parallel ridges or corrugations extend along or parallel to the longitudinal axis of the aerosol-generating article. This facilitates gathering of the crimped sheet of homogenised tobacco material to form the aerosol-generating substrate.

However, it will be appreciated that crimped sheets of homogenised tobacco material for inclusion in the aerosol-generating substrates of aerosol-generating articles according to the invention may alternatively or in addition have a plurality of substantially parallel ridges or corrugations that are disposed at an acute or obtuse angle to the longitudinal axis of the aerosol-generating article when the aerosol-generating article has been assembled.

Sheets of homogenised tobacco material for use in the invention may have a tobacco content of at least about 40 percent by weight on a dry weight basis, more preferably of at least about 50 percent by weight on a dry weight basis more preferably at least about 70 percent by weight on a dry weight basis and most preferably at least about 90 percent by weight on a dry weight basis.

Preferably, the sheets of homogenised tobacco material comprise an aerosol former. The sheets of homogenised tobacco material may comprise a single aerosol former. Alternatively, the sheets of homogenised tobacco material may comprise a combination of two or more aerosol formers.

Suitable aerosol-formers are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate, dimethyl tetradecanedioate, erythritol, 1,3-butylene glycol, tetraethylene glycol, triethyl citrate, propylene carbonate, Ethyl laurate, triacetin, meso-erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

Preferably, the sheets of homogenised tobacco material have an aerosol former content of greater than 5 percent on a dry weight basis.

The sheets of homogenised tobacco material may have an aerosol former content of between approximately 5 percent and approximately 30 percent on a dry weight basis.

In a preferred embodiment, the sheets of homogenised tobacco material have an aerosol former content of approximately 20 percent on a dry weight basis.

Sheets of homogenised tobacco material for use in the invention may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material for use in the aerosol-generating substrate may comprise other additives including, but not limited to, tobacco and non-tobacco fibres, aerosol-formers, humectants, plasticisers, flavourants, fillers, aqueous and non-aqueous solvents and combinations thereof.

Suitable extrinsic binders for inclusion in sheets of homogenised tobacco material for use in the invention are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Suitable non-tobacco fibres for inclusion in sheets of homogenised tobacco material for use in the aerosol-generating substrate are known in the art and include, but are not limited to: cellulose fibers; soft-wood fibres; hard-wood fibres; jute fibres and combinations thereof. Prior to inclusion in sheets of homogenised tobacco material for use in the aerosol-generating substrate, non-tobacco fibres may be treated by suitable processes known in the art including, but not limited to: mechanical pulping; refining; chemical pulping; bleaching; sulfate pulping; and combinations thereof.

Sheets of homogenised tobacco for use in the invention preferably have a width of between about 70 mm and about 250 mm, for example between about 120 mm and about 160 mm. Preferably, the thickness of the sheets of homogenised tobacco material is between about 50 micrometres and about 300 micrometres, more preferably between about 150 micrometres and about 250 micrometres.

Sheets of homogenised tobacco for use in the aerosol-generating article of the present invention may be made by methods known in the art, for example the methods disclosed in International patent application WO-A-2012/164009 A2.

In a preferred embodiment, sheets of homogenised tobacco material for use in the aerosol-generating article are formed from a slurry comprising particulate tobacco, guar gum, cellulose fibres and glycerine by a casting process.

As an alternative to the use of a gathered sheet of homogenised tobacco material, as described above, the aerosol-generating substrate may be formed of a plurality of strips or shreds of a sheet of homogenised tobacco material. For example, the aerosol-generating substrate may be formed of a plurality of shreds of homogenised tobacco material that are aligned in the longitudinal direction and have been brought together and wrapped to form a rod of aerosol-generating substrate.

The shreds of homogenised tobacco material preferably have a length of between about 10 millimetres and about 20 millimetres, more preferably between about 12 millimetres and about 18 millimetres, more preferably between about 14 millimetres and about 16 millimetres, more preferably about 15 millimetres. Alternatively or in addition, the shreds of homogenised tobacco material preferably have a width of between about 0.4 millimetres and about 0.8 millimetres.

Preferably, the density of the sheet of homogenised tobacco material from which the shreds are formed is between about 500 and about 1500 milligrams per cubic centimetre, more preferably between about 800 and about 1200 milligrams per cubic centimetre, more preferably between about 900 and about 1100 milligrams per cubic centimetre, and most preferably between about 900 and about 970 milligrams per cubic centimetre.

Preferably, the bulk density of the shreds of homogenised tobacco material within the aerosol-generating substrate is between about 0.4 grams per cubic centimetre and about 0.8 grams per cubic centimetre, preferably between about 0.5 grams per cubic centimetre and about 0.7 grams per cubic centimetre and most preferably between about 0.65 grams per cubic centimetre and about 0.67 grams per cubic centimetre.

As described above, the homogenised tobacco material may be formed by the casting of a slurry. Alternatively, the homogenised tobacco material may be formed by another suitable method, such as for example, an extrusion method.

Preferably, the aerosol-generating substrate comprises a rod of the homogenised tobacco material circumscribed by a wrapper, wherein the wrapper is provided around and in contact with the homogenised tobacco material. The wrapper may be formed from any suitable sheet material that is capable of being wrapped around homogenised tobacco material to form an aerosol-generating substrate. The wrapper may be porous or non-porous. Preferably, the wrapper is a paper wrapper but the wrapper may alternatively be non-paper.

The rod of aerosol-generating substrate preferably has an external diameter that is approximately equal to the external diameter of the aerosol-generating article.

Preferably, the rod of aerosol-generating substrate has an external diameter of at least 5 millimetres. The rod of aerosol-generating substrate may have an external diameter of between about 5 millimetres and about 12 millimetres, for example of between about 5 millimetres and about 10 millimetres or of between about 6 millimetres and about 8 millimetres. In a preferred embodiment, the rod of aerosol-generating substrate has an external diameter of 7.2 millimetres, to within 10 percent.

The rod of aerosol-generating substrate may have a length of between about 7 millimetres and about 15 mm. In one embodiment, the rod of aerosol-generating substrate may have a length of about 10 millimetres. In a preferred embodiment, the rod of aerosol-generating substrate has a length of about 12 millimetres.

Preferably, the rod of aerosol-generating substrate has a substantially uniform cross-section along the length of the rod. Particularly preferably, the rod of aerosol-generating substrate has a substantially circular cross-section.

The aerosol-generating articles according to the invention preferably comprise one or more elements in addition to the rod of aerosol-generating substrate and the heat control component. For example, aerosol-generating articles according to the invention may further comprise at least one of: a mouthpiece, an aerosol-cooling element and a support element such as a hollow acetate tube. For example, in one preferred embodiment, an aerosol-generating article comprises, in linear sequential arrangement, a rod of aerosol-generating substrate as described above, a support element located immediately downstream of the aerosol-generating substrate, an aerosol-cooling element located downstream of the support element, and an outer wrapper circumscribing the rod, the support element and the aerosol-cooling element. The heat control component is provided at a defined location upstream of the aerosol-generating substrate, as described above. In certain embodiments, the heat control component may replace the support element.

Aerosol-generating systems according to the present invention comprise an aerosol-generating article as described in detail above in combination with an aerosol-generating device which is adapted to receive the upstream end of the aerosol-generating article during smoking. The aerosol-generating device comprises a heating element which is configured to heat the aerosol-generating substrate in order to generate an aerosol during use. Preferably, the heating element is adapted to penetrate the aerosol-generating substrate when the aerosol-generating article is inserted into the aerosol-generating device. For example, the heating element is preferably in the form of a heater blade.

The heating element is controlled during use to operate with a defined operating temperature range, below a maximum operating temperature. The meltable element of the aerosol-generating article is adapted such that the threshold temperature will not be reached during normal use of the aerosol-generating article in the aerosol-generating device with the heating element operating below the maximum operating temperature. This ensures that when the aerosol-generating article and aerosol-generating device are used together, the meltable element will not be activated during normal use.

Preferably, the aerosol-generating device additionally comprises a housing, an electrical power supply connected to the heating element and a control element configured to control the supply of power from the power supply to the heating element.

Suitable aerosol-generating devices for use in the aerosol-generating system of the present invention are described in WO-A-2013/098405.

The invention will now be further described with reference to the figures in which:

FIG. 1 shows a schematic longitudinal cross-sectional view of an aerosol-generating article according to a first embodiment of the invention;

FIGS. 2*a* and 2*b* show a perspective view of the meltable element of the aerosol-generating article of FIG. 1, before and after activation of the heat control component, respectively;

FIGS. 3*a* and 3*b* show alternative meltable elements for use in the aerosol-generating article of FIG. 1;

Figure 1:
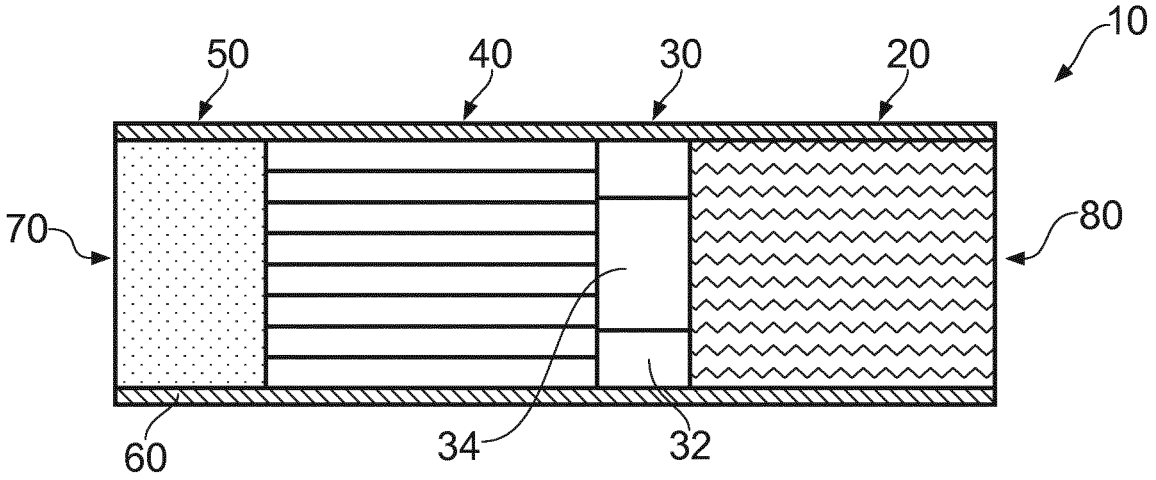

The aerosol-generating article 10 shown in FIG. 1 comprises four elements arranged in coaxial alignment: an aerosol-generating substrate 20, a heat control component 30, an aerosol-cooling element 40, and a mouthpiece 50. Each of the four elements is circumscribed by a corresponding plug wrap (not shown). These four elements are arranged sequentially and are circumscribed by an outer wrapper 60 to form the aerosol-generating article 10. The aerosol-generating 10 has a proximal or mouth end 70, which a user inserts into his or her mouth during use, and a distal end 80 located at the opposite end of the aerosol-generating article 10 to the mouth end 70.

In use air is drawn through the aerosol-generating article by a user from the distal end 80 to the mouth end 70. The distal end 80 of the aerosol-generating article may also be described as the upstream end of the aerosol-generating article 10 and the mouth end 70 of the aerosol-generating article 10 may also be described as the downstream end of the aerosol-generating article 10. Elements of the aerosol-generating article 10 located between the mouth end 70 and the distal end 80 can be described as being upstream of the mouth end 70 or, alternatively, downstream of the distal end 80.

The aerosol-generating substrate 20 is located at the extreme distal or upstream end of the aerosol-generating article 10. In the embodiment illustrated in FIG. 1, aerosol-generating substrate 20 comprises a gathered sheet of crimped homogenised tobacco material circumscribed by a wrapper. The crimped sheet of homogenised tobacco material comprises glycerin as an aerosol former.

The heat control component 30 is located immediately downstream of the aerosol-generating substrate 20 and abuts the aerosol-generating substrate 20. In the embodiment shown in FIG. 1, the heat control component 30 consists of a meltable disc 32 having a transverse cross section substantially corresponding to the transverse cross-section of the aerosol-generating substrate 20.

Figure 2A:
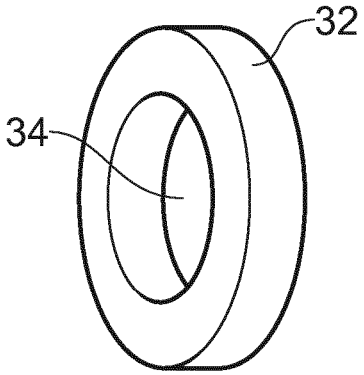

FIG. 2*a* shows the meltable disc 32 prior to activation of the heat control component 30. As shown in FIG. 2*a*, the meltable disc 32 comprises a single central hole 34 having a circular shape with a diameter of approximately 4 millimetres. The central hole 34 provides an airflow channel through the meltable disc. The meltable disc 32 is formed of a meltable material having a melting point of approximately 150 degrees Celsius so that the threshold temperature above with the heat control component is activated is approximately 150 degrees Celsius.

Figure 2B:
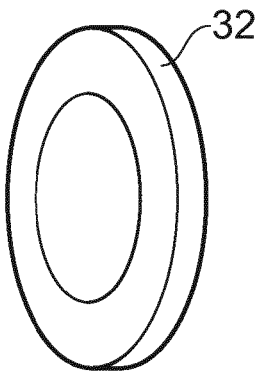

If the threshold temperature of 150 degrees Celsius is exceeded at the heat control component 30 due to overheating of the aerosol-generating article 10, the heat control component 30 will activate and the meltable disc 32 will melt. The resultant melted material will flow transversely to block the single central hole 34. FIG. 2*b* shows the meltable disc 32 after activation of the heat control component 30, with the single central hole 34 blocked so that airflow through the meltable disc 34 is substantially prevented and the aerosol-generating article 10 can no longer be used.

In the embodiment shown in FIG. 1, the heat control component 30 further acts as a support element to locate the aerosol-generating substrate 20 at the extreme distal end 80 of the aerosol-generating article 10 so that it can be penetrated by a heating element of an aerosol-generating device. As described further below, a support element is in place to prevent the aerosol-generating substrate 20 from being forced downstream within the aerosol-generating article 10 towards the aerosol-cooling element 40 when a heating element of an aerosol-generating device is inserted into the aerosol-generating substrate 20. A support element also acts as a spacer to space the aerosol-cooling element 40 of the aerosol-generating article 10 from the aerosol-generating substrate 20.

The aerosol-cooling element 40 is located immediately downstream of the heat control component 30 and abuts the meltable disc 32. In use, volatile substances released from the aerosol-generating substrate 20 pass along the aerosol-cooling element 40 towards the mouth end 70 of the aerosol-generating article 10. The volatile substances may cool within the aerosol-cooling element 40 to form an aerosol that is inhaled by the user. In the embodiment illustrated in FIG. 1, the aerosol-cooling element comprises a crimped and gathered sheet of polylactic acid circumscribed by a wrapper 90. The crimped and gathered sheet of polylactic acid defines a plurality of longitudinal channels that extend along the length of the aerosol-cooling element 40.

The mouthpiece 50 is located immediately downstream of the aerosol-cooling element 40 and abuts the aerosol-cooling element 40. In the embodiment illustrated in FIG. 1, the mouthpiece 50 comprises a conventional cellulose acetate tow filter of low filtration efficiency.

To assemble the aerosol-generating article 10, the four elements described above are aligned and tightly wrapped within the outer wrapper 60. In the embodiment illustrated in FIG. 1, the outer wrapper 60 is a conventional cigarette paper. A distal end portion of the outer wrapper 60 of the aerosol-generating article 10 is circumscribed by a band of tipping paper (not shown).

Figure 3A:
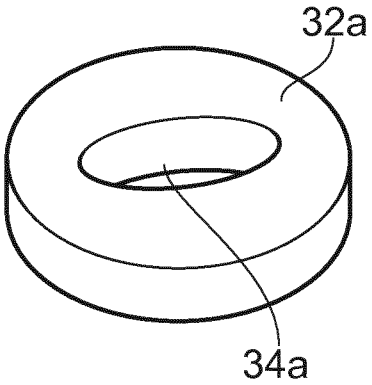

FIG. 3*a* shows an alternative meltable disc 32*a* for use as the heat control component 30 in the aerosol-generating article 10 shown in FIG. 1. The meltable disc 32*a* has a similar structure and function to the meltable disc 32 described above and is formed of a similar material. However, in the meltable disc 32*a* shown in FIG. 3*a*, the single central hole 34*a* has an elongate, oval shape.

Figure 3B:
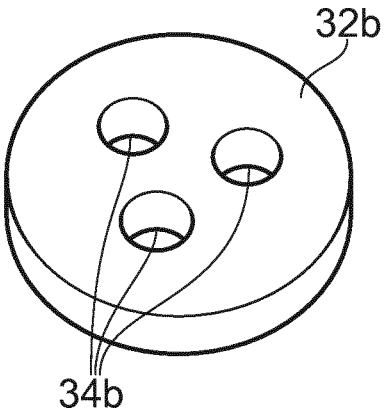

FIG. 3*b* shows a further alternative meltable disc 32*b* for use as the heat control component 30 in the aerosol-generating article 10 shown in FIG. 1. The meltable disc 32*b* has a similar structure and function to the meltable disc 32 described above and is formed of a similar material. However, in the meltable disc 32*b* shown in FIG. 3*b*, three spaced apart holes 34*b* are provided, each having a circular shape with a diameter of approximately 1.5 millimetres.

Figure 4:
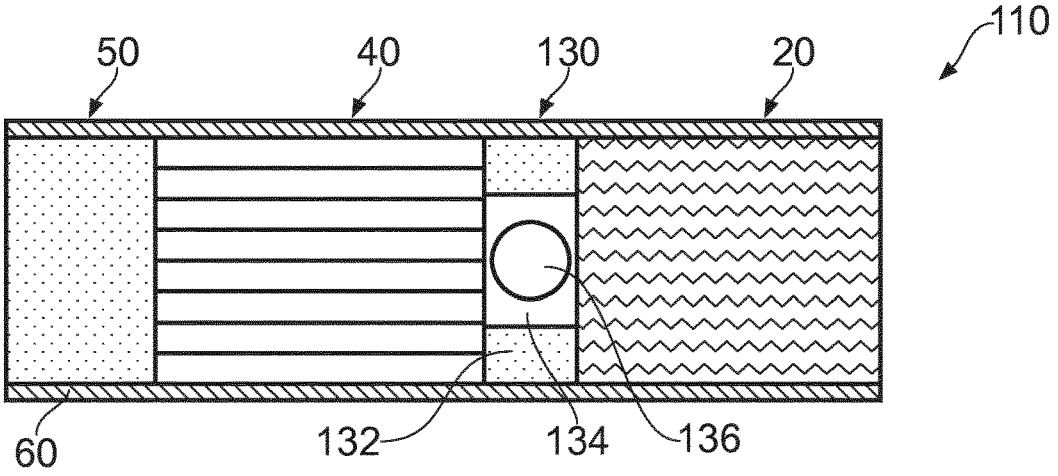
FIG. 4 shows a schematic longitudinal cross-sectional view of an aerosol-generating article according to a second embodiment of the invention.

FIG. 4 shows an aerosol-generating article 110 according to a second embodiment of the present invention. The aerosol-generating article 110 has a similar structure to the aerosol-generating article 10 shown in FIG. 1 and described above, except that the aerosol-generating article 110 comprises a heat control component 130 having a different structure to that described above. All other components of the aerosol-generating article 110 are as described above in relation to the aerosol-generating article 10 shown in FIG. 1 and the same reference numerals have been applied.

The heat control component 130 of the aerosol-generating article 110 shown in FIG. 4 comprises a tubular support element 132 in the form of a hollow acetate tube having a central longitudinal channel 134 extending through it. The tubular support element 132 abuts the downstream end of the aerosol-generating substrate 20 and has an outer diameter that substantially corresponds to the outer diameter of the aerosol-generating substrate 132. The tubular support element 132 acts as a support element within the aerosol-generating article 110 as described above in relation to the aerosol-generating article 10.

Inside the longitudinal channel 134 of the tubular support element 132 is mounted a meltable element in the form of a spherical bead 136 formed of a meltable material having a melting point of approximately 150 degrees Celsius. FIG. 4 shows the heat control component 130 prior to activation. As shown, the spherical bead 136 has a diameter that is smaller than the internal diameter of the longitudinal channel 134 of the tubular support element 132 so that spaces are provided around the spherical bead 136 to allow for airflow through the longitudinal channel 134.

Figure 5:
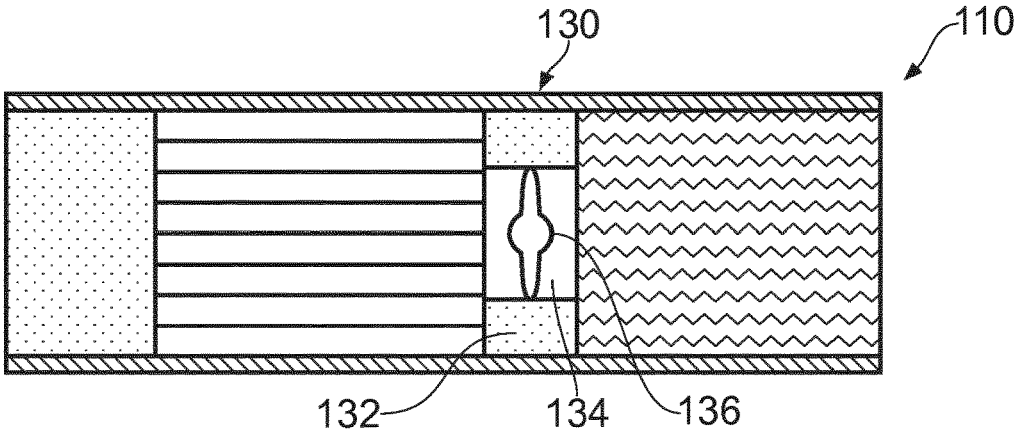
FIG. 5 shows the aerosol-generating article of FIG. 4, after activation of the heat control component.

If the threshold temperature of 150 degrees Celsius is exceeded at the heat control component 130 due to overheating of the aerosol-generating article 110, the heat control component 130 will activate and the spherical bead 136 will melt. The resultant melted material will flow transversely to form a flattened disc that blocks the longitudinal channel 134 of the tubular support element. FIG. 5 shows the aerosol-generating article 110 after activation of the heat control component 130, with the longitudinal channel 134 blocked by the melted material from the spherical bead 136, so that airflow through the tubular support element 132 is substantially prevented and the aerosol-generating article 110 can no longer be used.

Figure 6:
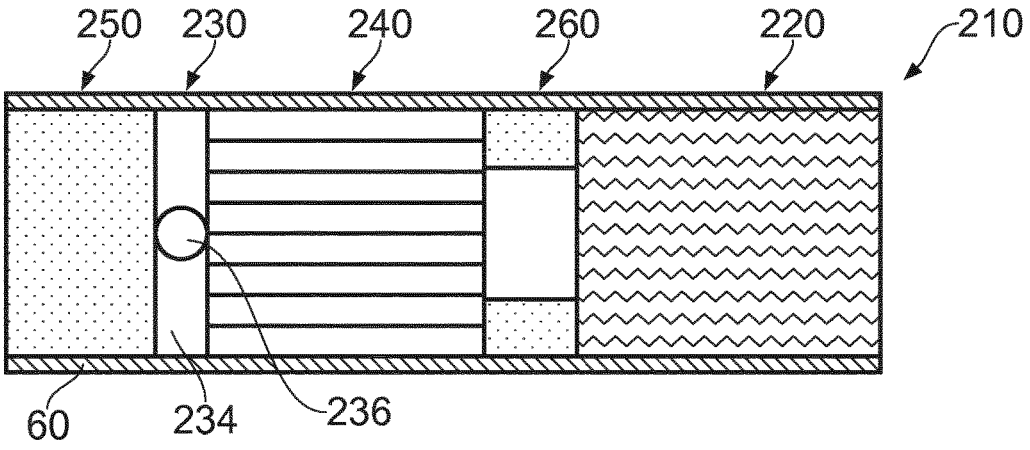
FIG. 6 shows a schematic longitudinal cross-sectional view of an aerosol-generating article according to a third embodiment of the invention.

FIG. 6 shows an aerosol-generating article 210 according to a third embodiment of the present invention, in which the heat control component 230 is provided in a different location to the aerosol-generating articles described above. The aerosol-generating article 210 comprises five elements arranged in coaxial alignment: an aerosol-generating substrate 220, a support element 260, an aerosol-cooling element 240, a heat control element 230 and a mouthpiece 250. Each of the five elements is circumscribed by a corresponding plug wrap (not shown). These five elements are arranged sequentially and are circumscribed by an outer wrapper 60 to form the aerosol-generating article 210.

The aerosol-generating substrate 220, the aerosol-cooling element 240 and the mouthpiece 250 correspond to the aerosol-generating substrate 20, the aerosol-cooling element 40 and the mouthpiece 50 of the aerosol-generating article 10, as described above. The support element 260 is in the form of a hollow cellulose acetate tube located immediately downstream of the aerosol-generating substrate 220 and it provides the functions described above in relation to aerosol-generating article 10.

In the aerosol-generating article 210 of FIG. 6, the heat control component 230 is provided further downstream than in the first and second embodiments described above, between the aerosol-cooling element 240 and the mouthpiece 250. The heat control component 230 comprises a cavity 234 defined by an outer layer of plug wrap (not shown) circumscribing the aerosol-generating article 210 at the position of the heat control component 230.

Inside the cavity 234 is mounted a meltable element in the form of a spherical bead 236 formed of a meltable material having a melting point of approximately 120 degrees Celsius. The threshold temperature of the heat control component 230 is therefore approximately 120 degrees, which is lower than for the first and second embodiments described above due to the positioning of the heat control component 230 further from the aerosol-generating substrate 220.

FIG. 6 shows the heat control component 230 prior to activation. As shown, the spherical bead 236 has a diameter that is significantly smaller than the internal diameter of the cavity 234 so that spaces are provided around the spherical bead 236 to allow for airflow through the cavity 234.

Figure 7:
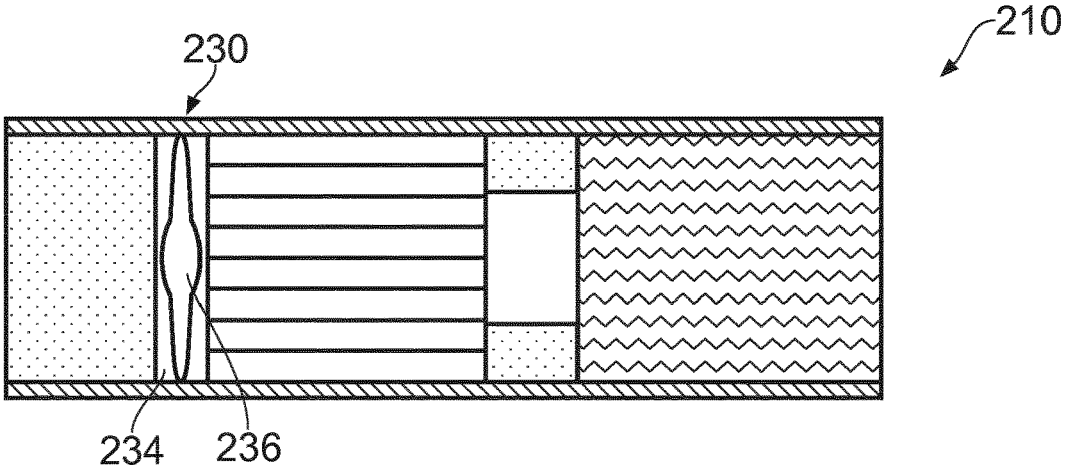
FIG. 7 shows the aerosol-generating article of FIG. 6, after activation of the heat control component.

If the threshold temperature of 120 degrees Celsius is exceeded at the heat control component 230 due to overheating of the aerosol-generating article 210, the heat control component 230 will activate and the spherical bead 236 will melt. The resultant melted material will flow transversely to form a flattened disc that blocks the cavity 234. FIG. 7 shows the aerosol-generating article 210 after activation of the heat control component 230, with the cavity 234 blocked by the melted material from the spherical bead 236, so that airflow through the cavity is substantially prevented and the aerosol-generating article 210 can no longer be used.

The aerosol-generating articles illustrated in the above described figures are designed to engage with an aerosol-generating device comprising a heating element in order to be consumed by a user. In use, the heating element of the aerosol-generating device heats the aerosol-generating substrate of the aerosol-generating article to a sufficient temperature to form an aerosol, which is drawn downstream through the aerosol-generating article and inhaled by the user.

Figure 8:
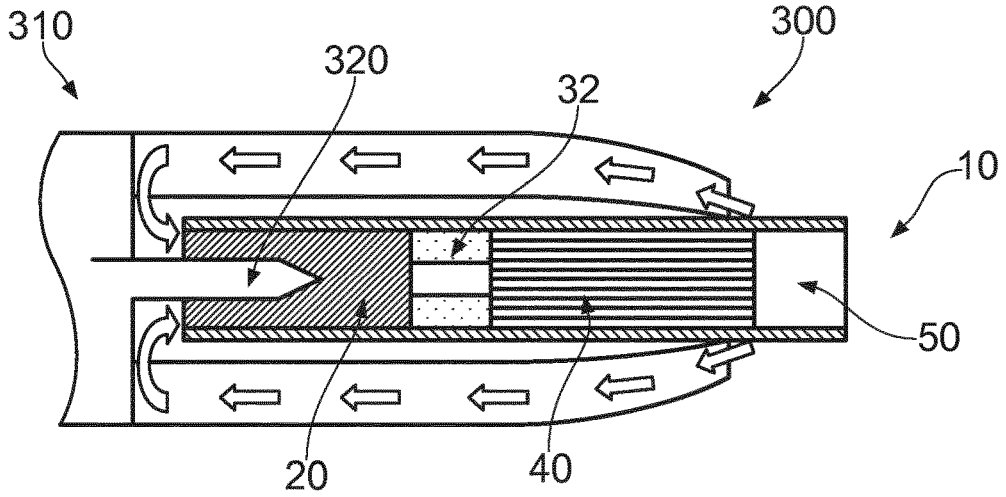
FIG. 8 is a schematic cross-sectional view of an aerosol-generating system comprising an aerosol-generating device and an aerosol generating article according to the invention.

FIG. 8 illustrates a portion of an aerosol-generating system 300 comprising an aerosol-generating device 310 and an aerosol-generating article 10 according to the first embodiment described above and shown in FIG. 1. It will be appreciated that the aerosol-generating device 310 could be used in combination with an alternative aerosol-generating article according to the invention, such as any of the other embodiments described above and shown in the Figures.

The aerosol-generating device 310 comprises a heating element 320. As shown in FIG. 8, the heating element 320 is mounted within an aerosol-generating article receiving chamber of the aerosol-generating device 310. In use, the user inserts the aerosol-generating article 10 into the aerosol-generating article receiving chamber of the aerosol-generating device 310 such that the heating element 320 is directly inserted into the aerosol-generating substrate 20 of the aerosol-generating article 10 as shown in FIG. 8. In the embodiment shown in FIG. 8, the heating element 320 of the aerosol-generating device 310 is a heater blade.

The aerosol-generating device 310 comprises a power supply and electronics (shown in FIG. 3) that allow the heating element 320 to be actuated. Such actuation may be manually operated or may occur automatically in response to a user drawing on an aerosol-generating article 10 inserted into the aerosol-generating article receiving chamber of the aerosol-generating device 310. A plurality of openings is provided in the aerosol-generating device to allow air to flow to the aerosol-generating article 10; the direction of airflow is illustrated by arrows in FIG. 8.

The meltable disc 32 of the heat control component 30 of the aerosol-generating article 10 acts as a support element to resist the penetration force experienced by the aerosol-generating article 10 during insertion of the heating element 320 of the aerosol-generating device 310 into the aerosol-generating substrate 20. The meltable disc 32 thereby resists downstream movement of the aerosol-generating substrate 20 within the aerosol-generating article 10 during insertion of the heating element 320 of the aerosol-generating device 310 into the aerosol-generating substrate 20.

Once the internal heating element 320 is inserted into the aerosol-generating substrate 20 of the aerosol-generating article 10 and the heating element 320 is actuated, the aerosol-generating substrate 20 of the aerosol-generating article 10 is heated to a temperature of approximately 350 degrees Celsius by the heating element 320 of the aerosol-generating device 310. At this temperature, volatile compounds are evolved from the aerosol-generating substrate 20 of the aerosol-generating article 10. As a user draws on the mouth end 70 of the aerosol-generating article 10, the volatile compounds evolved from the aerosol-generating substrate 20 are drawn downstream through the aerosol-generating article 10 and condense to form an aerosol that is drawn through the mouthpiece 50 of the aerosol-generating article 10 into the user's mouth.

As the aerosol passes downstream thorough the aerosol-cooling element 40, the temperature of the aerosol is reduced due to transfer of thermal energy from the aerosol to the aerosol-cooling element 40. When the aerosol enters the aerosol-cooling element 40, its temperature is approximately 60 degrees Celsius. Due to cooling within the aerosol-cooling element 40, the temperature of the aerosol as it exits the aerosol-cooling element is approximately 40 degrees Celsius.

Figure 9:
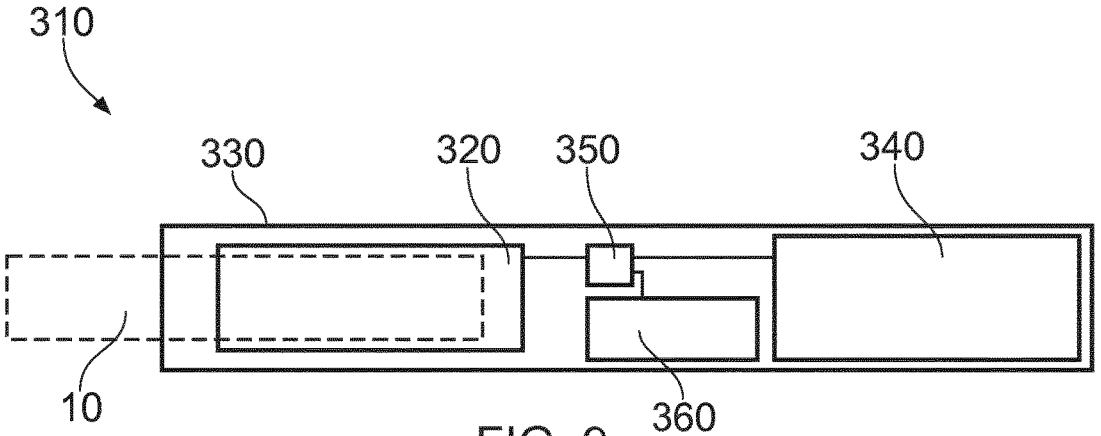
FIG. 9 is a schematic cross-sectional view of the electrically heated aerosol generating device of FIG. 8.

In FIG. 9, the components of the aerosol-generating device 310 are shown in a simplified manner. Particularly, the components of the aerosol-generating device 310 are not drawn to scale in FIG. 9. Components that are not relevant for the understanding of the embodiment have been omitted to simplify FIG. 9.

As shown in FIG. 9, the aerosol-generating device 310 comprises a housing 330. The heating element 320 is mounted within an aerosol-generating article receiving chamber within the housing 330. The aerosol-generating article 10 (shown by dashed lines in FIG. 9) is inserted into the aerosol-generating article receiving chamber within the housing 330 of the aerosol-generating device 310 such that the heating element 320 is directly inserted into the aerosol-generating substrate 20 of the aerosol-generating article 10.

Within the housing 330 there is an electrical energy supply 340, for example a rechargeable lithium ion battery. A controller 350 is connected to the heating element 320, the electrical energy supply 340, and a user interface 360, for example a button or display. The controller 350 controls the power supplied to the heating element 320 in order to regulate its temperature.

During this normal usage of the aerosol-generating articles according to the invention with the compatible aerosol-generating device 310 shown in FIGS. 8 and 9, the heat control component within the aerosol-generating article is unaffected and the aerosol can pass through the airflow channels in the meltable element as described above.

In the event that the aerosol-generating articles according to the invention are used with a non-compatible device and are overheated to above a preferred maximum operating temperature, the heat control component will activate upon reaching the predetermined threshold temperature. As described above in relation to the separate embodiments, the activation of the heat control component brings about the melting of the meltable element. The resultant melted material flows within the heat control component to block any airflow channels through the heat control component. After activation of the heat control component, the aerosol-generating article can therefore no longer be used.

As such, the incorporation of the heat control component into the aerosol-generating articles of the present invention provides an effective means of protecting the consumer from use of the aerosol-generating article in an unintended manner in a non-compatible device.

The invention claimed is:

1. An aerosol-generating article for an aerosol-generating device having a heating element, the aerosol-generating article comprising:

a rod of aerosol-generating substrate; and a heat control component disposed downstream of the rod of aerosol-generating substrate and comprising a meltable element, wherein the meltable element is arranged within the heat control component such that one or more longitudinal airflow channels are provided through the heat control component, and wherein the meltable element is configured to melt when heated above a threshold temperature such that upon melting of the meltable element the one or more longitudinal airflow channels through the heat control component are blocked whereby airflow through the aerosol-generating article is substantially prevented.

2. The aerosol-generating article according to claim 1, wherein the meltable element of the heat control component comprises a meltable disc having a transverse cross section substantially corresponding to a transverse cross-section of the rod of aerosol-generating substrate, and one or more holes extending through the meltable disc to provide the one or more longitudinal airflow channels.

3. The aerosol-generating article according to claim 2, wherein the meltable disc comprises a single hole to provide a single longitudinal airflow channel through the meltable disc.

4. The aerosol-generating article according to claim 2, wherein the meltable disc comprises a plurality of spaced apart holes to provide a plurality of longitudinal airflow channels through the disc.

5. The aerosol-generating article according to claim 1, wherein the heat control component further comprises a central longitudinal cavity, wherein the meltable element is mounted within the central longitudinal cavity such that the one or more longitudinal airflow channels are provided through the central longitudinal cavity around the meltable element, and wherein upon melting of the meltable element the central longitudinal cavity is blocked.

6. The aerosol-generating article according to claim 5, wherein the meltable element is in the form of a spherical bead having a diameter that is smaller than a transverse diameter of the central longitudinal cavity of the heat control component.

7. The aerosol-generating article according to claim 5, wherein the central longitudinal cavity is defined by a plug wrap circumscribing at least a portion of the aerosol-generating article.

8. The aerosol-generating article according to claim 5, wherein the heat control component further comprises a hollow tubular element having a central channel defining the central longitudinal cavity, in which the meltable element is mounted.

9. The aerosol-generating article according to claim 1, wherein the heat control component is provided adjacent the aerosol-generating substrate, and wherein a threshold temperature at which the meltable element melts is at least 140 degrees Celsius.

10. The aerosol-generating article according to claim 9, wherein the meltable element is formed of a plastics material having a melting point of at least 140 degrees Celsius.

11. The aerosol-generating article according to claim 9, wherein the meltable element is formed of a crystalline solid having a melting point of at least 140 degrees Celsius.

12. The aerosol-generating article according to claim 1, further comprising a mouthpiece at a mouth end, wherein the heat control component is provided adjacent to the mouthpiece, and wherein a threshold temperature at which the meltable element melts is at least 80 degrees Celsius.

13. The aerosol-generating article according to claim 12, wherein the meltable element is formed of a microcrystalline wax having a melting point of at least 80 degrees Celsius.

14. The aerosol-generating article according to claim 12, wherein the meltable element is sealed within a flexible outer cover layer.

15. An aerosol-generating system, comprising:

an aerosol-generating article according to claim 1; and an aerosol-generating device configured to receive the aerosol-generating article, the aerosol-generating device comprising a heating element configured to heat a rod of aerosol-generating substrate, wherein the heating element is configured to be controlled so as to operate below a maximum operating temperature, and wherein a meltable element of the aerosol-generating article is configured such that a threshold temperature is not exceeded during use of the aerosol-generating system with the heating element operating below the maximum operating temperature.

* * * * *